United States Patent [19]

Erdbrink

[11] Patent Number: 4,898,288

[45] Date of Patent: Feb. 6, 1990

[54] SEMI-SUBMERSIBLE CRANE VESSEL

[75] Inventor: Robert J. Erdbrink, Leiden, Netherlands

[73] Assignee: Heerema Engineering Service BV, Leiden, Netherlands

[21] Appl. No.: 708,441

[22] Filed: Mar. 5, 1985

[30] Foreign Application Priority Data

Mar. 5, 1984 [GB] United Kingdom ..... 8405689

[51] Int. Cl.[4] ..... B63B 39/03

[52] U.S. Cl. ..... 212/191; 114/121; 114/125; 114/333

[58] Field of Search ..... 212/191; 114/125, 333, 114/264, 265, 121, 122

[56] References Cited

U.S. PATENT DOCUMENTS

| | | | |
|---|---|---|---|
| 695,108 | 3/1902 | Maxim | 114/333 |
| 726,705 | 4/1903 | Lake | 114/333 |
| 754,222 | 3/1904 | Lake | 114/333 |
| 836,892 | 11/1906 | Pulliam | 114/333 |
| 1,232,667 | 7/1917 | Fernandez | 114/333 |
| 3,689,953 | 9/1972 | Markakis | 114/125 |
| 4,207,828 | 6/1980 | Horowitz et al. | 114/125 |
| 4,231,313 | 11/1980 | Heerema et al. | 114/125 |

*Primary Examiner*—Sherman D. Basinger
*Assistant Examiner*—Thomas J. Brahan
*Attorney, Agent, or Firm*—Fulwider, Patton, Lee & Utecht

[57] ABSTRACT

A semi-submersible crane vessel has a chamber (3) which is open to the sea at the bottom. A piston (4) is movable up and down in the chamber by means of hydraulic jacks (5 and 6) acting on piston rod (7). The part (10) of the chamber above the piston contains air, which may be pressurized via air valve (13) to balance the pressure on both sides of the piston. To stabilize the vessel during movement of a load on the crane (2), the piston is moved in the chamber. This alters the underwater volume of the vessel and therefore its buoyancy.

7 Claims, 6 Drawing Sheets

SEMI-SUBMERSIBLE CRANE VESSEL

The invention relates to a semi-submersible crane vessel and in particular to an improved means for stabilizing the vessel during variation or movement of a load carried by the crane.

When a semi-submersible crane vessel lifts a load extra submergence takes place and when the load is located eccentrically of the vessel large pitch and roll angles will appear. These angles are, for heavy loads, outside the allowed inclinations for the crane boom and perpendicular to the crane boom. It is thus desirable to keep the vessel as close to its original position during load variations or changes and to make compensation for such variations or changes.

It has already been proposed in British Patent Specifications Nos. 1594903 and 1579191 to provide a stabilizing system for a semi-submersible crane vessel and these specifications show two different systems.

It is an object of the present invention to provide a quick-acting alternative stabilization system for a semi-submersible crane vessel.

The invention provides a semi-submersible crane vessel having a heavy lift crane and means for levelling the vessel to compensate for variation of a load carried by the crane, which means comprises means to increase or decrease the underwater volume of part of the vessel to alter the buoyancy of the vessel.

The levelling means may comprise a piston acting in a chamber.

The chamber may be open to the water surrounding the vessel and the piston may be elongate and movable to a position where it extends outboard of the vessel, or the piston may be movable between a position in which the chamber is closed and a position in which the chamber is open by an amount corresponding to the position of the piston along its stroke in the chamber.

The piston may contain ballast.

The chamber may be closed on the inboard side of the piston, in which case there is preferably means to introduce compressed air into the chamber on the inboard side of the piston to balance the pressure on the two sides of the piston.

The invention also provides a semi-submersible crane vessel having a heavy lift crane and means for levelling the vessel to compensate for variation of a load carried by the crane, which means comprises a chamber, a piston movable in the chamber between a lower position below the water level of the vessel and an upper position at least level with the water level of the vessel, means to allow water to flood into the chamber above the piston when in a lower position and means to allow water to flood out of the chamber when the piston is in an upper position.

The levelling means are preferably provided at at least two corners of the vessel, and are preferably received at least partly in columns of the vessel. The levelling means may be controlled automatically in response to detection of a variation in attitude of the vessel and/or the load.

Specific examples of semi-submersible crane vessels embodying the features of the invention will now be described with reference to the accompanying diagrammatic drawings in which.

Figure 1:
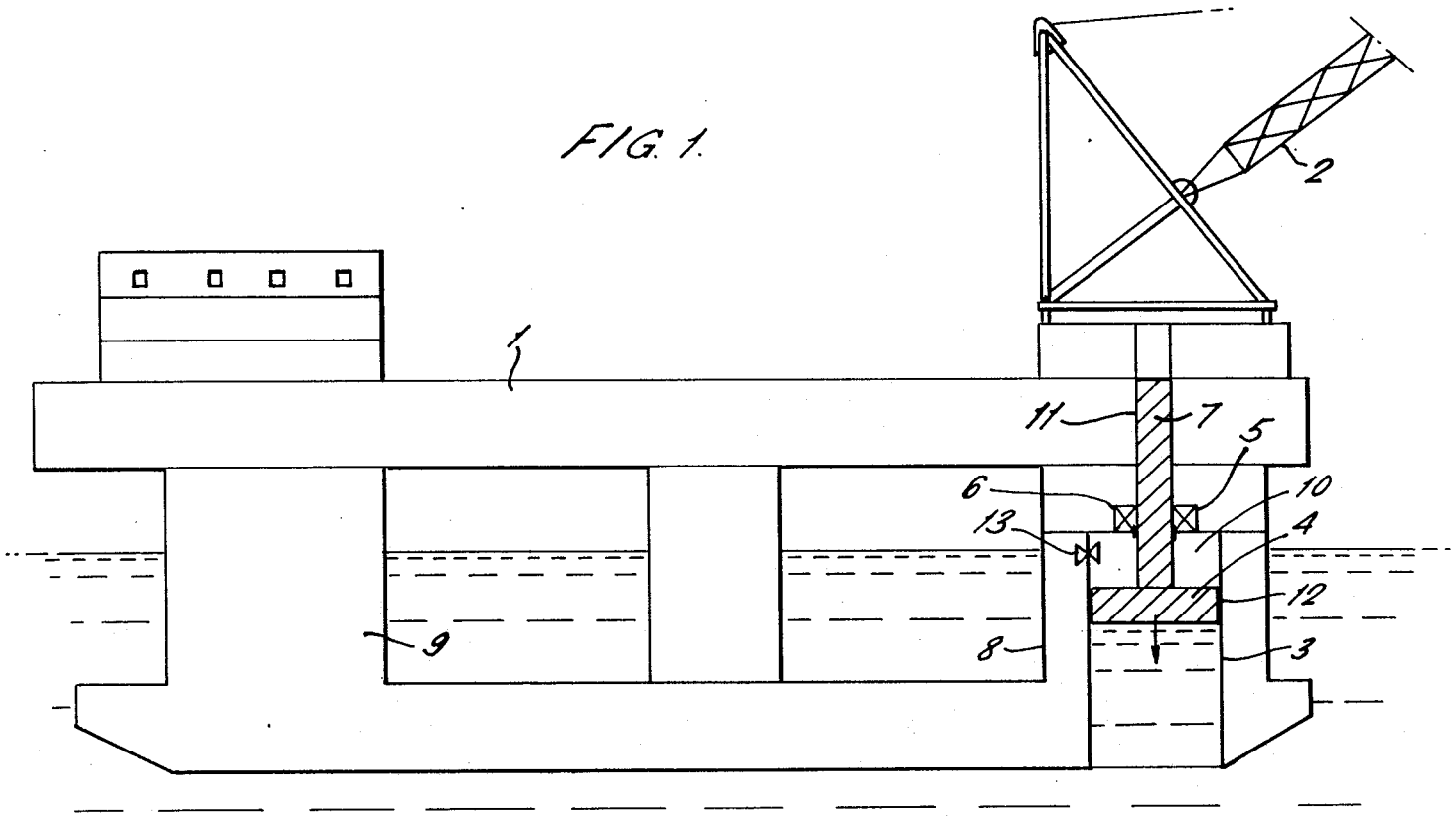
FIG. 1 is a side view of a semi-submersible crane vessel with one of the columns partly in section.

Referring first of all to FIG. 1, a vessel (1) is provided with a heavy lift crane (2) and a number of columns joining the floaters to the working deck of which the two end pairs are numbered (8) and (9).

A ballast chamber (3) of, for example, circular or square cross-section is provided in each of the columns (8) and working within the chamber (3) is a piston (4) having a piston rod (7) slidable in a tube (11). Rails and/or water tight seals (12) may be provided for the piston (4) The chambers (3) are open at their bottoms to the sea and the upper parts of the pistons have air valves (13) through which compressed air can be driven into the chambers if desired to relieve pressure on any seals between the pistons and the chambers. (10) represents the deballasted part of chamber (3).

The piston rod (7) is driven up and down by means of, for example, hydraulic jacks (5) and (6) which are of the type described in Dutch Patent Specification No. 78.01926. These hydraulic jacks are of course double acting so that the piston can be driven in either direction.

Figure 2:
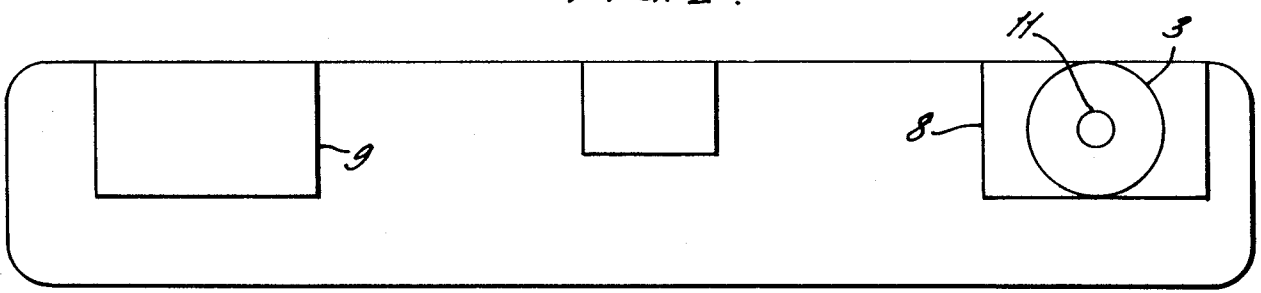
FIG. 2 is a plan view of the vessel of FIG. 1.
Figure 2:
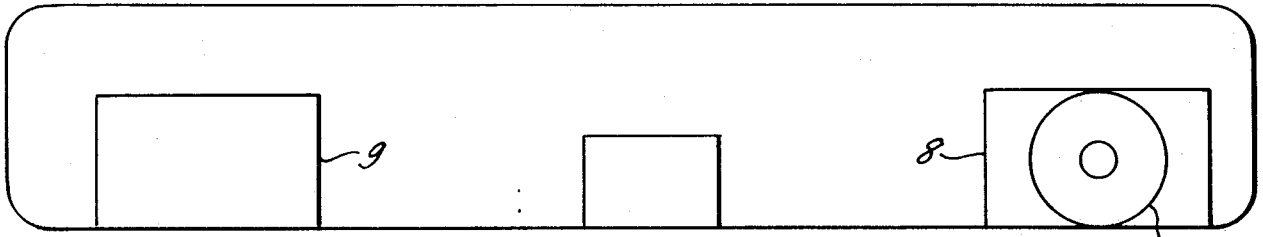

As can be seen from FIG. 2, similar arrangements are provided in the two columns (8) although of course they could be provided in one or more columns depending upon the design of the vessel; for example ballast chambers and pistons could be positioned on all four corner columns to provide optimum righting movements.

Figure 3:
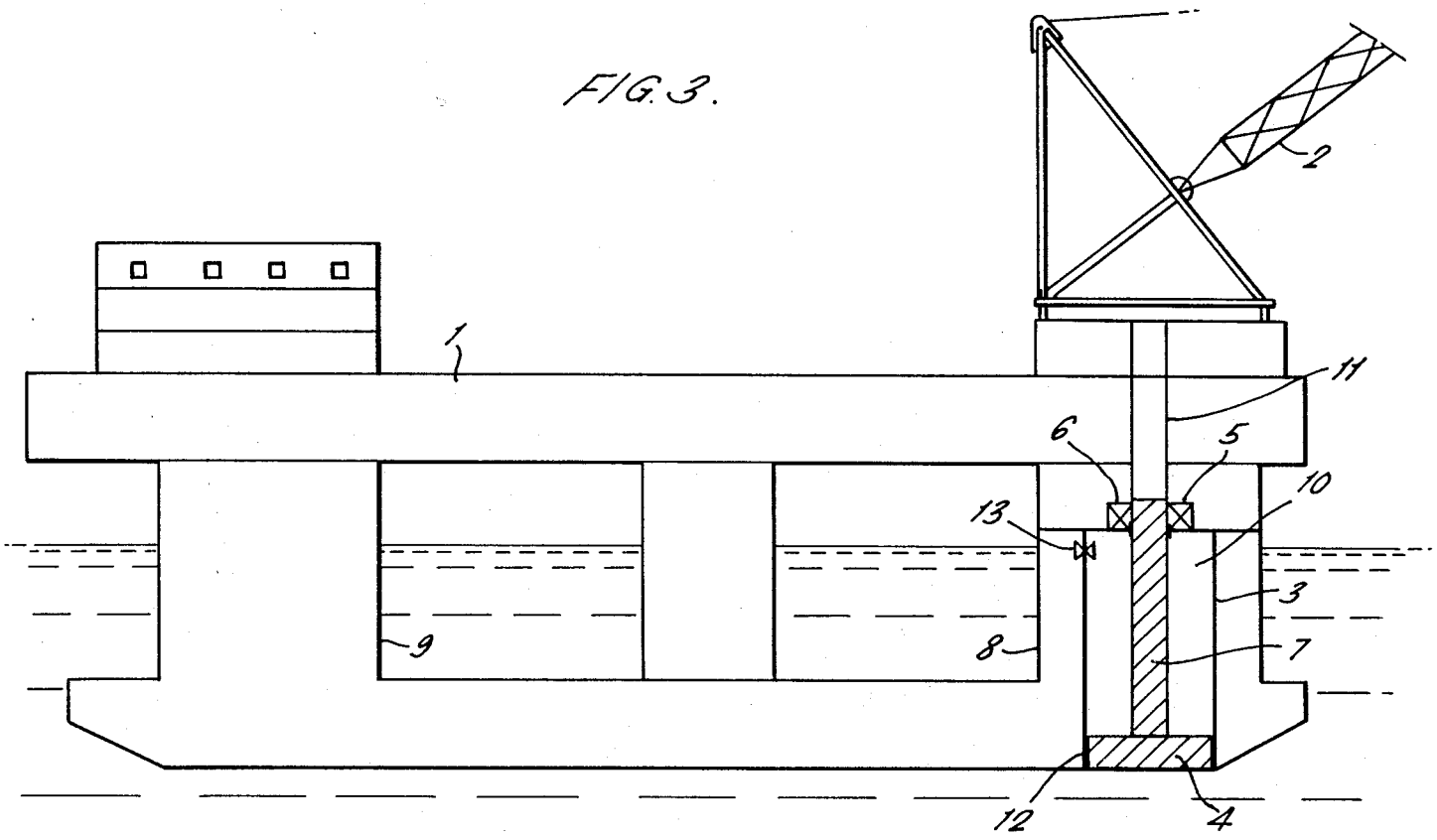
FIG. 3 is a side view corresponding to FIG. 1 but with the chamber containing no sea water.

FIG. 3 shows the arrangement when the piston has been moved to its lowermost position in the chamber (3) and it will be appreciated that during movement of the piston the buoyancy of the vessel will be altered which enable compensation to be made for the lifting of a load by the crane (2). If desired this can be done via a computer or by any other method.

Figure 4:
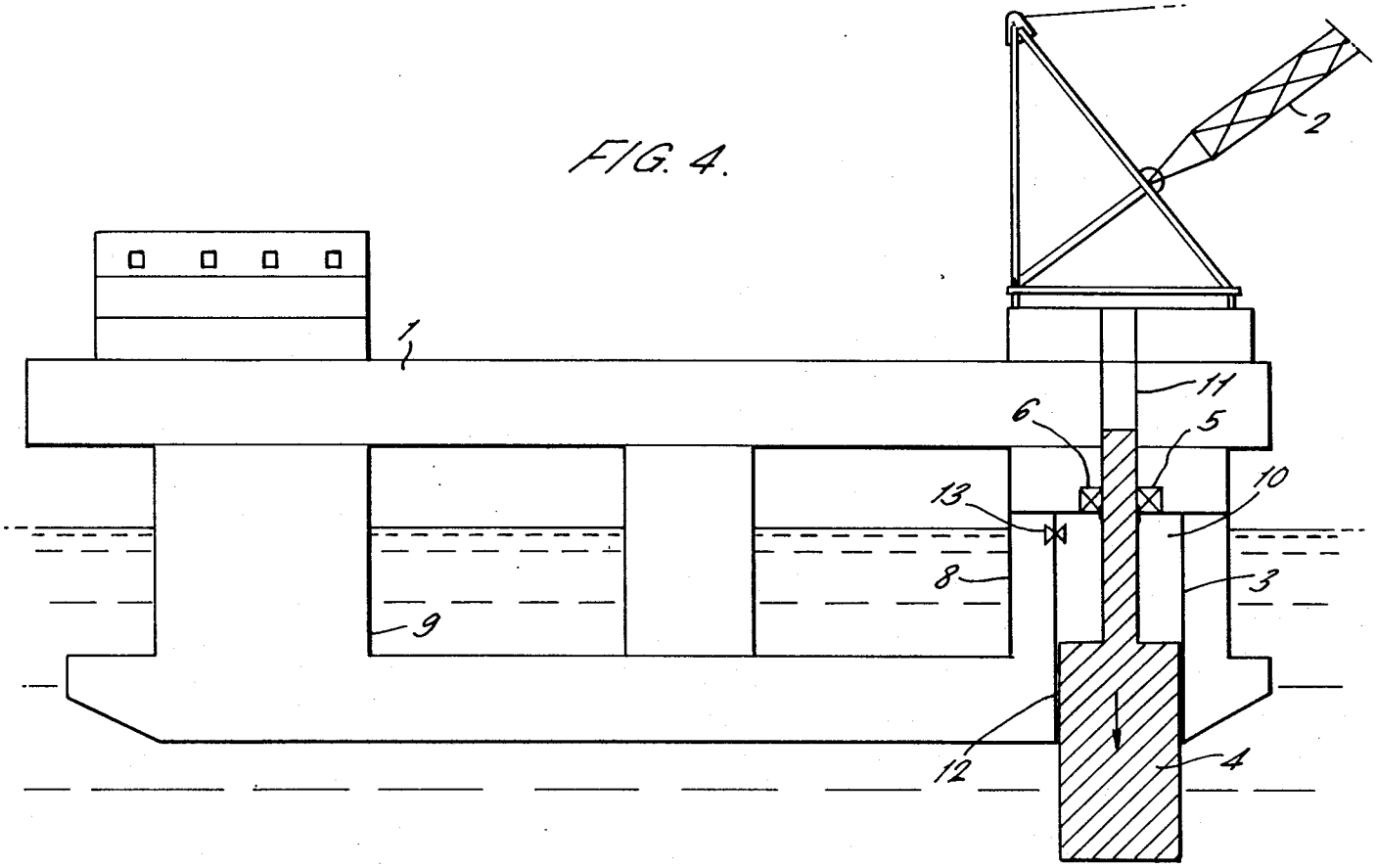
FIG. 4 is a side view of a second embodiment of a semi-submersible crane vessel.

In the vessel described and shown in FIG. 4 the pistons (4) are elongate, and they may contain ballast. It will be appreciated that instead of the piston (4) causing sea water to be expelled from the chamber (3) here, the elongate piston (4) is either retracted so that it does not protrude below the contour of the vessel or is arranged to protrude outboard of the vessel to alter the buoyancy of the vessel. In the position shown in FIG. 4 the vessel is provided with increased stability and an increase in its radius of gyration. All of this helps to reduce crane hook motion.

Figure 5:
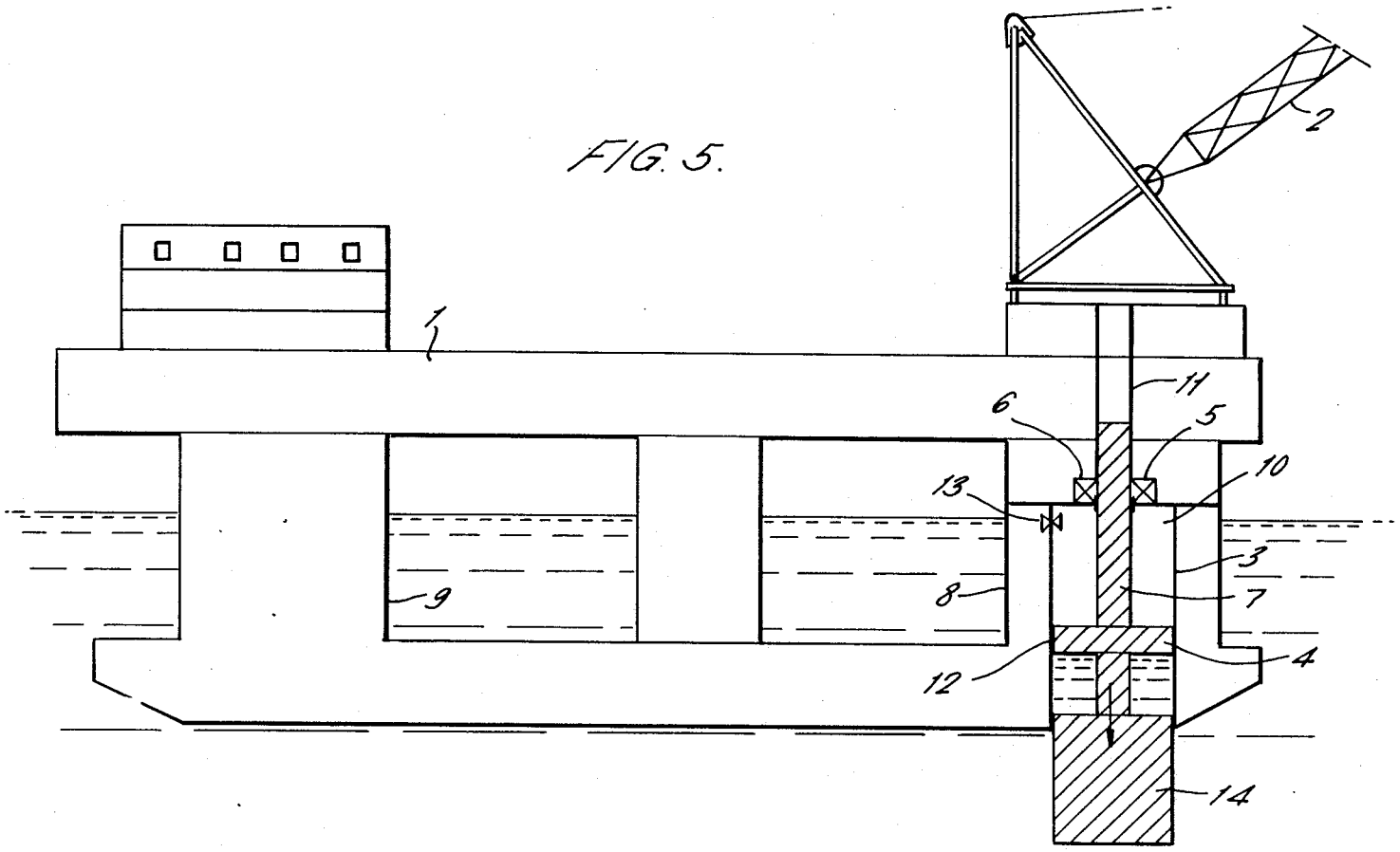
FIG. 5 is a side view of a third embodiment of a semi-submersible vessel.

The arrangement shown in FIG. 5 is an alternative construction to that which is shown in FIG. 4. Here, the piston (4) is provided with an extension having a weight (14), water being received in the space between the piston (4) and the weight (14). The piston and weight can be lowered to a position where the space is in communication with the surrounding water.

Figure 6:
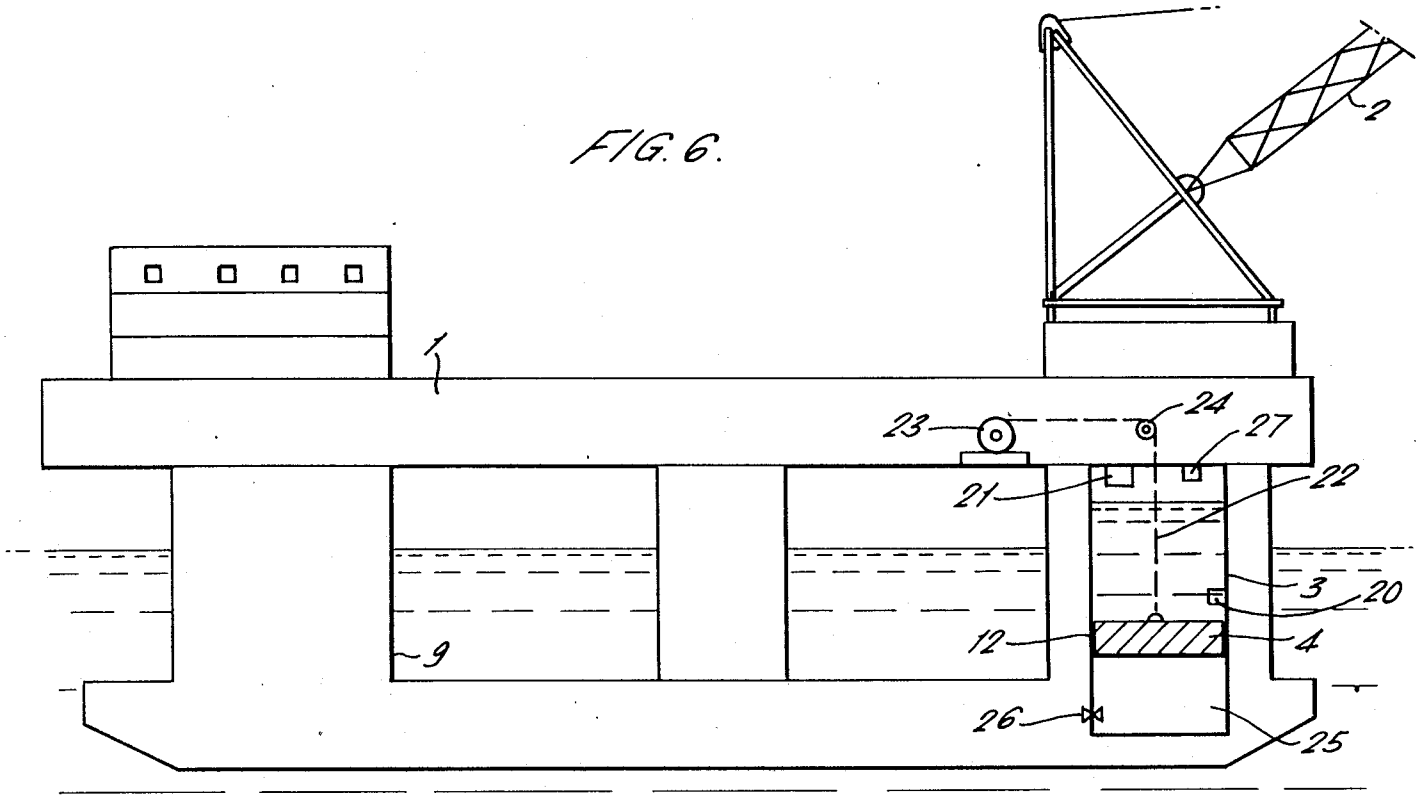
FIG. 6 is a side view of a fourth embodiment of a semi-submersible crane vessel

The arrangement of FIG. 6 is somewhat different in that a piston (4) working in the chamber (3) is raised by means of a winch (23), a pulley (24) and a chain or wire (22) and can be lowered under its own weight and by the weight of incoming water. Of course, other means for raising and lowering the piston could equally well be used. The chamber (3) has a water inlet valve (20), a water outlet valve (21) and a valve (27) for letting air into the chamber when the piston is being lowered. An air valve (26) allows compressed air to enter into the chamber (25), which is the deballasted part of the chamber to decrease buoyancy, water is allowed to flood into chamber (3) initially when piston (4) is at the bottom of the chamber. To increase buoyancy, the water inlet (20) is closed off, the piston (4) and the body of water above it are lifted in the chamber, and then water is emptied from the chamber by opening the valve 27 and by lifting the piston up to the top of the chamber allowing water to flood out of the valve 27. Compressed air from valve (26) is used to balance the pressure across the piston. In this case, (25) is the deballasted part of chamber (3).

In each of the embodiments the pistons provide a rapid means of levelling the vessel as a load is carried by the crane. For example during setting or lifting of a load the effect of the load on the crane varies very rapidly and the vessel must be capable of rapid response. If chambers and pistons are provided at the four corners of the vessel it is possible for one piston or pair of pistons to be moved in one direction while another piston or the other pair of pistons is moved in the opposite direction. Thus buoyancy of the vessel can be increased say locally at one end of the vessel while the buoyancy is being decreased locally at the other end of the vessel. In this way the buoyancy is being altered although the total buoyancy remains the same if the movements of the pistons are equal and opposed.

It is important that each piston should be controllable independently so that the vessel can compensate for variations of load.

An advantage of the invention is the increase in speed of the stabilization system. Furthermore the quick ballasting and deballasting of the ballast chambers includes the possibility to change the vessel draft considerably in a very short time period, so that the ballast system can be used to assist in lifting or setting crane loads in a minimum amount of time.

This reduction of time is important to limit the variation, due to wave induced vessel motions, as much as possible. For example, after setting of a module on a platform, the module can be lifted again due to the vertical wave induced crane hook motions. At the moment of setting of the module re-uplift can be avoided by very quick ballasting of the vessel. Normal ballast systems do not reach the required ballasting speed to avoid this re-uplifting.

I claim:

1. In a semi-submersible crane vessel having a heavy lift crane mounted on a working deck of the vessel, which working deck is supported by a plurality of columns which extend from a buoyant structure that is at least partly submerged, the combination of:

a chamber formed at least partly in two of said columns, each chamber having a longitudinal axis that extends vertically;

a vertically movable piston slidably arranged in each of said chambers, with each chamber being open to sea water below its respective piston;

independently controlled power-operated means on the vessel directly connected to each piston to effect vertical movement of the pistons in opposite directions within their respective chambers to alter the buoyancy of the vessel and thereby rapidly compensate for variations of load carried by the crane whereby said vessel is maintained substantially level during operation of the crane; and valve means that admit air into said chambers above said pistons.

2. A crane vessel as set forth in claim 1 wherein movement of said pistons is controlled automatically in response to detection of a variation in the magnitude of the load being lifted by the crane.

3. A crane vessel as set forth in claim 1 wherein the bottom of the chamber is open to the sea water surrounding the vessel and each piston is movable between a position in which its respective chamber is closed and a position in which its respective chamber is open by an amount corresponding to the position of the piston along its stroke in the chamber.

4. A crane vessel as set forth in claim 1 wherein the piston is elongate and is movable to a position where it extends outboard of the vessel.

5. A crane vessel as set forth in claim 1 wherein the piston is provided at its lower end with downward extension having a weight, with sea water being received in the space between the bottom of the piston and the top of the weight.

6. A crane vessel as set forth in claim 1 wherein compressed air enters into the chamber through said valve means to balance the pressure on the upper and lower surfaces of the piston.

7. A crane vessel as set forth in claim 1 wherein each corner of the vessel is provided with one of said columns, chambers and pistons.

* * * * *